US006497557B2

(12) United States Patent
Aden et al.

(10) Patent No.: US 6,497,557 B2
(45) Date of Patent: Dec. 24, 2002

(54) SLIDING VANE PUMP

(75) Inventors: David R. Aden, Saginaw, MI (US); Thomas C. Rytlewski, Auburn, MI (US); Jerrod M. Etienne, El Paso, TX (US); David Fredrick Hammerbacher, Saginaw, MI (US); Bruce Alan Tucker, Brighton, MI (US); Roy William Heath, Midland, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/748,486

(22) Filed: Dec. 27, 2000

(65) Prior Publication Data

US 2002/0081210 A1 Jun. 27, 2002

(51) Int. Cl.[7] ..... F04B 23/08
(52) U.S. Cl. ..... 417/87; 418/15; 417/302
(58) Field of Search ..... 417/76, 79, 87, 417/88; 418/15, 259

(56) References Cited

U.S. PATENT DOCUMENTS

| | | | | | |
|---|---|---|---|---|---|
| 1,558,639 | A | * | 10/1925 | Schmied | 418/83 |
| 2,068,918 | A | * | 1/1937 | Kagi | 103/135 |
| 4,183,723 | A | * | 1/1980 | Hansen et al. | 417/204 |
| 4,516,918 | A | * | 5/1985 | Drutchas et al. | 418/15 |
| 4,752,195 | A | * | 6/1988 | Friedrich et al. | 417/540 |
| 4,789,317 | A | * | 12/1988 | Waser et al. | 418/189 |
| 5,975,868 | A | * | 11/1999 | Agner | 418/259 |
| 6,050,796 | A | * | 4/2000 | Wong et al. | 418/132 |
| 6,120,256 | A | * | 9/2000 | Miyazawa | 417/220 |
| 6,149,409 | A | * | 11/2000 | Palakodati et al. | 418/15 |

* cited by examiner

*Primary Examiner*—Charles G. Freay
*Assistant Examiner*—Han Lieh Liu
(74) *Attorney, Agent, or Firm*—Edmund P. Anderson

(57) ABSTRACT

A sliding vane pump comprising a rotor housing having a pumping chamber, a rotor in the pumping chamber having a plurality of radially disposed slots, and a plurality of sliding vanes disposed in the slots configured to extend to follow an inner wall of said pumping chamber.

36 Claims, 6 Drawing Sheets

SLIDING VANE PUMP

TECHNICAL FIELD

This invention relates to sliding vane pumps.

BACKGROUND OF THE INVENTION

Sliding vane pumps are typically used to provide hydraulic pressure and flow to various types of hydraulic systems, such as hydraulic power assist steering systems in automobiles. One example of a common sliding vane pump includes a rotor eccentrically mounted in a cylindrical chamber. As the rotor rotates, vanes within the rotor slide in and out to follow the contour of the housing, pushing fluid from an inlet port to an outlet port in the process.

Another style is referred to as a hydraulically balanced sliding vane pump, which uses a rotor configuration such as that shown in FIG. 2. In this configuration, rotor 12 is centrally located in an oblong, or elliptical chamber 15 defined by pump ring 13. Chamber 15 includes two inlets 16 and two outlets 18, with rotor 12 rotating counter-clockwise as shown. Vanes 22 are radially disposed in radial slots 24. Under the influence of fluid pressure from down stream of the outlets 18, vanes 22 are urged out of slots 24 to follow the contour of chamber 15. Vanes 22 therefore urge fluid along in spaces, or pumping cavities, between the vanes from the inlets 16 to outlets 18 as rotor 12 rotates.

The function of the pumping cavity is to transfer a discrete volume of fluid at low pressure to high pressure. This happens repeatedly during a rotation of the pump shaft due to the presence of multiple pumping cavities. The end result is a steady flow of fluid discharged from the discharge port. Ideally for this to occur, the volume of fluid in the pumping cavity will be compressed and just reach the particular discharge pressure as it is allowed to enter the discharge port, providing a smooth transition from low to high pressure. However, this is seldom the case in practice. During operation, the pressure of the fluid in the pumping cavity is not the same as the pressure of the fluid in the discharge port just prior to the leading vane passing the discharge port. If the pressure in the cavity is lower than the pressure in the discharge port, fluid will quickly flow into the pumping cavity as the leading vane passes the discharge port. Conversely, if the pressure in the pumping cavity is higher than that in the discharge port, then fluid will quickly flow out of the pumping cavity as the leading vane passes the discharge port. This flow pulse is superimposed upon the steady flow of oil discharged from the discharge port. This small but quick flow pulse results in a corresponding pressure pulse (positive or negative) in the discharge port when the leading vane passes the discharge port.

Since the pressure pulse occurs every time the leading vane passes the discharge port, the pulse occurs at vane passage frequency. Since there are multiple vanes passing the discharge port during one revolution of the pump shaft, and the pump shaft is rotated at a constant speed, the vane passage frequency will be an integer multiple of the pump shaft rotation frequency.

The pressure pulse acts upon components within the pump, and components located downstream of the pump, causing these components to vibrate at the corresponding frequency of the pulse. Vibration of these components can radiate sound that is undesirable.

The annoyance of pump noise is due not only because it is loud, but also because it is tonal in nature, due to the repeating of discrete pumping cycles, which occur with equal time intervals between them, every time a vane passes the outlet ports of the pump.

Another drawback to sliding vane hydraulic pumps is that their speed range is limited by cavitation of the fluid within the pumping chamber. Cavitation is the formation and collapse of low-pressure bubbles in liquids. These bubbles are caused by air or vapor absorbed or otherwise entrained in the hydraulic fluid. Cavitation greatly increases pressure ripple which causes excessive noise and vibration, as well as loss of performance. The use of a jet supercharger to increase the inlet pressure to the pump has been used to increase the speed at which cavitation becomes audible, but these efforts have not sufficiently increased cavitation speed for many applications. Another approach has been to remove the air from the hydraulic fluid, but this has proven to be difficult in practice. Yet another drawback is that sliding vane pumps have a fixed capacity, i.e., they pump a fixed amount of fluid in each revolution of the rotor. This is a serious drawback of this type of pump in certain applications. For example, in the automotive industry, the hydraulic pump is often driven by an internal combustion engine that operates at a speed independent of the needed hydraulic power.

SUMMARY OF THE INVENTION

The above-listed drawbacks and disadvantages of the prior art sliding vane pumps are overcome or alleviated by a high speed dual discharge sliding vane hydraulic pump with two external discharge ports for varying the capacity of the pump and/or irregularly spaced vanes to reduce the tonal characteristics of noise caused by pressure ripple effects and/or increasing the inlet slot length to increase the cavitation speed.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
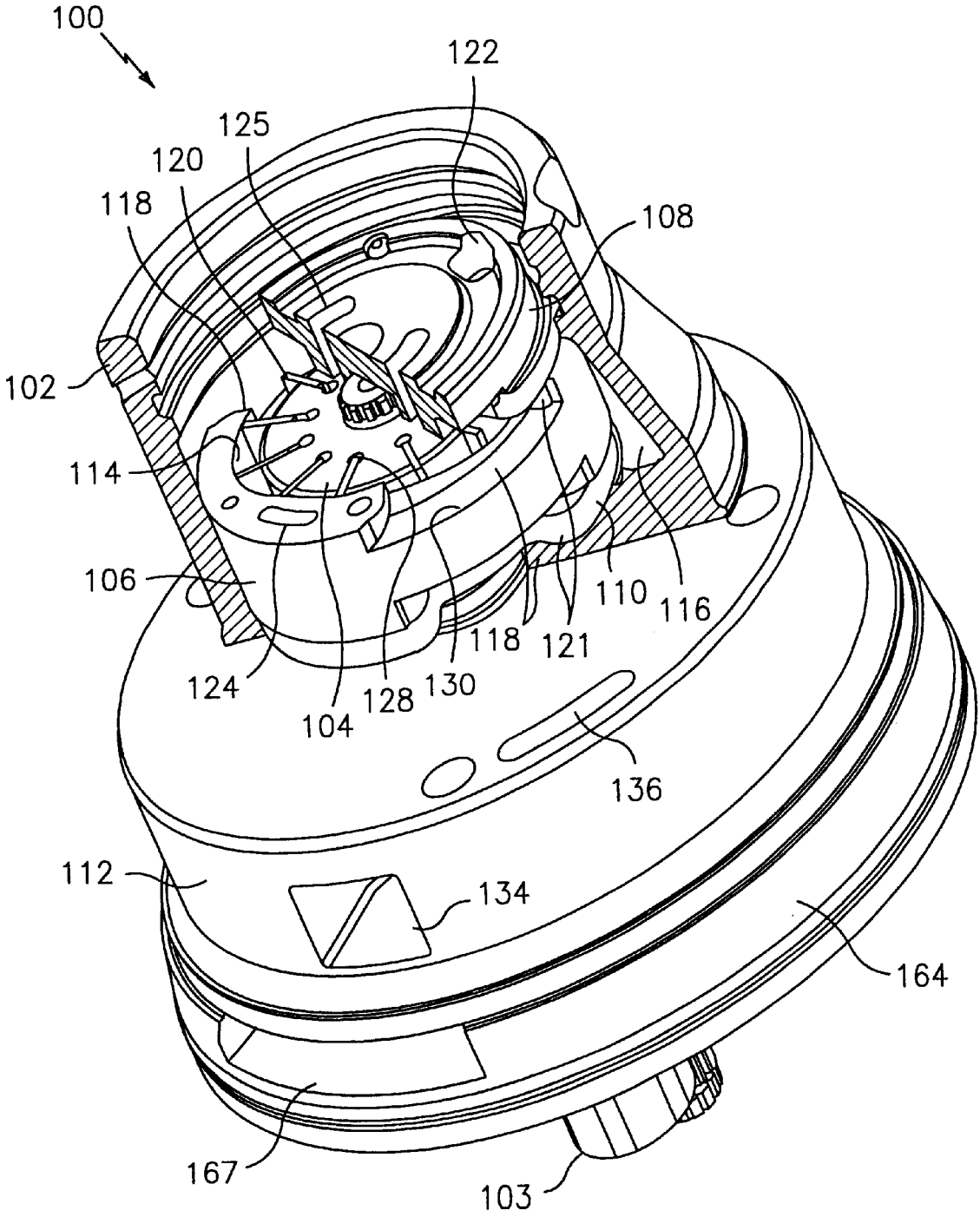
FIG. 1 is a cut-away perspective view of a hydraulic pump.

FIG. 1 shows a cut-away view of pump 100. Pump 100 includes a rotor housing 102 supporting a pressure plate 108, pump ring 106 and thrust plate 110, which define the pump chamber 114 in which rotor 104 resides. Rotor housing 102 and discharge housing 112 are preferably formed as different portions of a unitary structure, but are treated separately herein so that individual portions may be referred to more easily. Fluid enters rotor housing 102 through an external inlet (not shown) and is directed to annular space 116. From annular space 116, fluid enters internal inlets 118, which are located on either side of rotor 104. Internal inlets 118 are formed by notches in pump ring 106, thrust plate 110, and pressure plate 108, described in further detail below. Fluid radially enters pump chamber 114 through these notches and is motivated by vanes 120 to axial internal discharge ports 122 (only one shown). There are actually four internal discharge ports, two located in pressure plate 108, and two more in thrust plate 110. A pressure plate cover (not shown) encloses the space immediately above pressure plate 108 and directs hydraulic fluid through axial ports 124 in pump ring 106 to discharge housing 112. Pressure plate 108 has elongated curved slots 125 to direct high pressure fluid to spaces 128 behind each vane 120, causing each vane 120 to slide out until the tip reaches the inside surface of pump ring 106.

Figure 2:
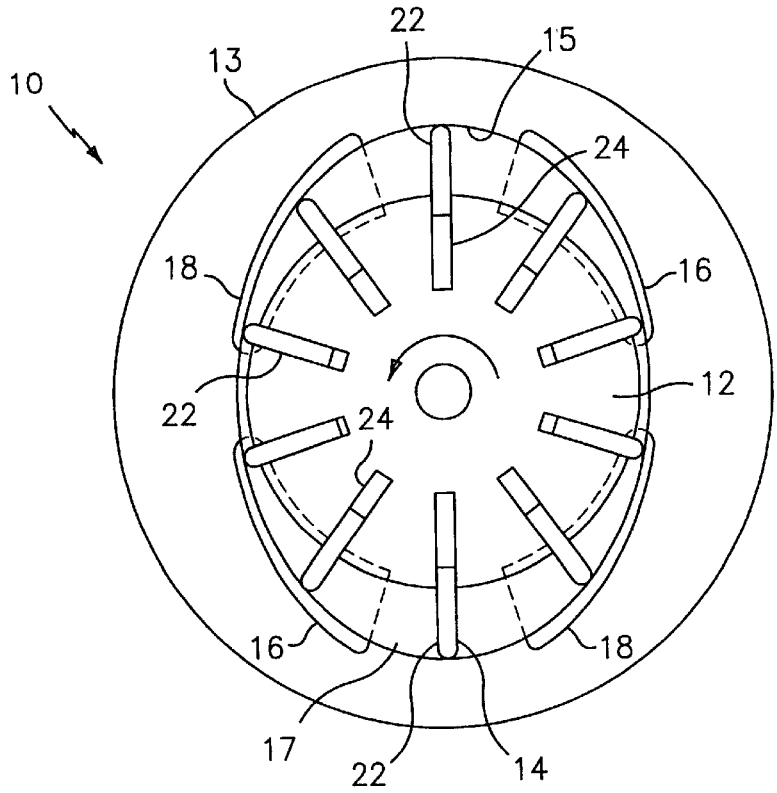
FIG. 2 (PRIOR ART)
FIG. 2 is a schematic representation of a typical sliding vane hydraulic pump of the prior art.

Referring to FIG. 2, a schematic of a typical balanced hydraulic sliding vane pump 10 is shown, including rotor 12, pump ring 13, inlet ports 16, discharge ports 18, and 10 equally spaced sliding vanes 22. During operation, the pressure of fluid in a pumping cavity 17 is sometimes not the same as the pressure of fluid in the discharge port just prior to the leading vane 14 passing the discharge port. If the pressure in cavity 17 is lower than the pressure in discharge port 18, fluid will quickly flow into the pumping cavity as the leading vane 14 opens pumping cavity 17 to the discharge port. If the pressure in cavity 17 is greater than the pressure in discharge port 18, fluid will quickly flow out of the pumping cavity as the leading vane 14 opens pumping cavity 17 to the discharge port. This process is repeated as each vane opens the next pumping cavity to the discharge port.

This small but quick flow pulse results in a corresponding pressure pulse (positive or negative) in the discharge port when each vane opens a pressure cavity to the discharge port. Since the pressure pulse occurs every time the leading vane passes the discharge port, the pulse occurs at vane passage frequency, the frequency being an integer multiple of the pump shaft rotation frequency. In the example shown in FIG. 2 having ten vanes, the frequency of the pressure pulse will be ten times the shaft rotation frequency.

The pressure pulse acts upon components within the pump, and components located downstream of the pump, causing these components to vibrate at the corresponding frequency of the pulse, as well as harmonics thereof.

Figure 3:
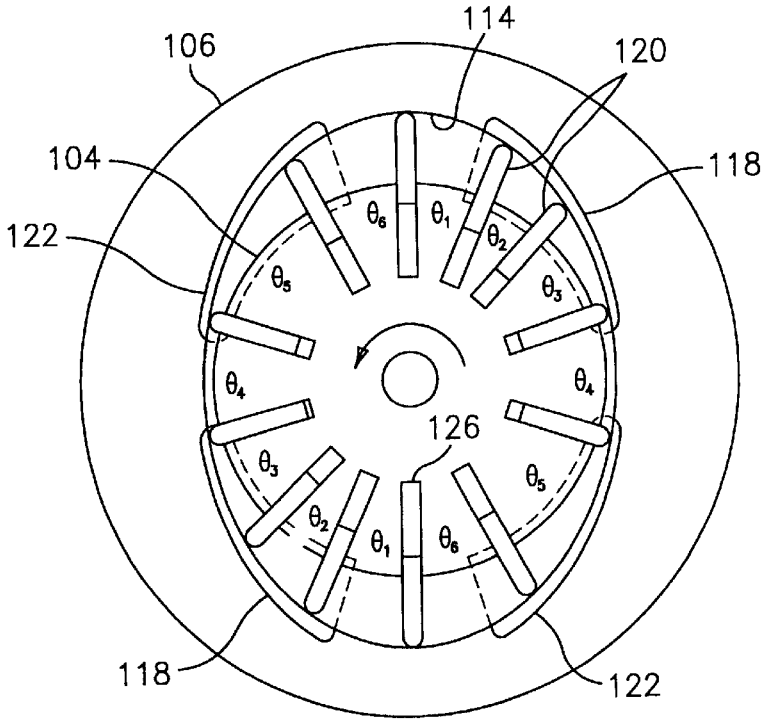
FIG. 3 is another schematic representation of a pump.

FIG. 3 shows schematic representation of pumping chamber 114 having rotor 104 disposed therein having 12 unequally spaced vane slots 126 carrying vanes 120. Slots 126 are located such that the angles between the first six consecutive slots, $\theta_n$, are not duplicated with the first six slots. However, the angles between the second six consecutive slots are identical to the angles between the first six slots as shown in the diagram. This repeating of the angles between slots 126 in the second set of six slots 126 provides for mechanical and hydraulic balance of rotor 104. In other words, for each vane slot 126, there is another vane slot 126 located 180 degrees, or on the opposite side of rotor 104 providing for mechanical balance. Where the pressure differential is not so great that perfect balancing must be maintained, the vanes may be at varying angles without the repetition described above. In such a configuration, it may be desirable to off-set vanes so that vanes on opposite sides of the rotor do not clear the outlet port simultaneously, thus further reducing pressure ripple effects.

The uneven spacing of the slots 126 minimizes the periodicity of the pressure ripple that causes noise. By placing the vanes at unequal angles, the pump activity within one revolution of the pump is repeated at multiple frequencies, thereby spreading the sound energy to an increasing number of fundamental frequencies and their corresponding harmonics. Since this spread-spectrum, or broadband noise is much easier to mask by other ambient sounds than tonal noise, the pump noise is perceived to be lower. While the 12 vane configuration shown in FIG. 3 has proven advantageous in reducing tonal noise, it should be noted that a rotor having just one or two vanes set off-set from an equally spaced configuration would noticeably reduce the tonal noise generated by the pump.

Example

Figure 4:
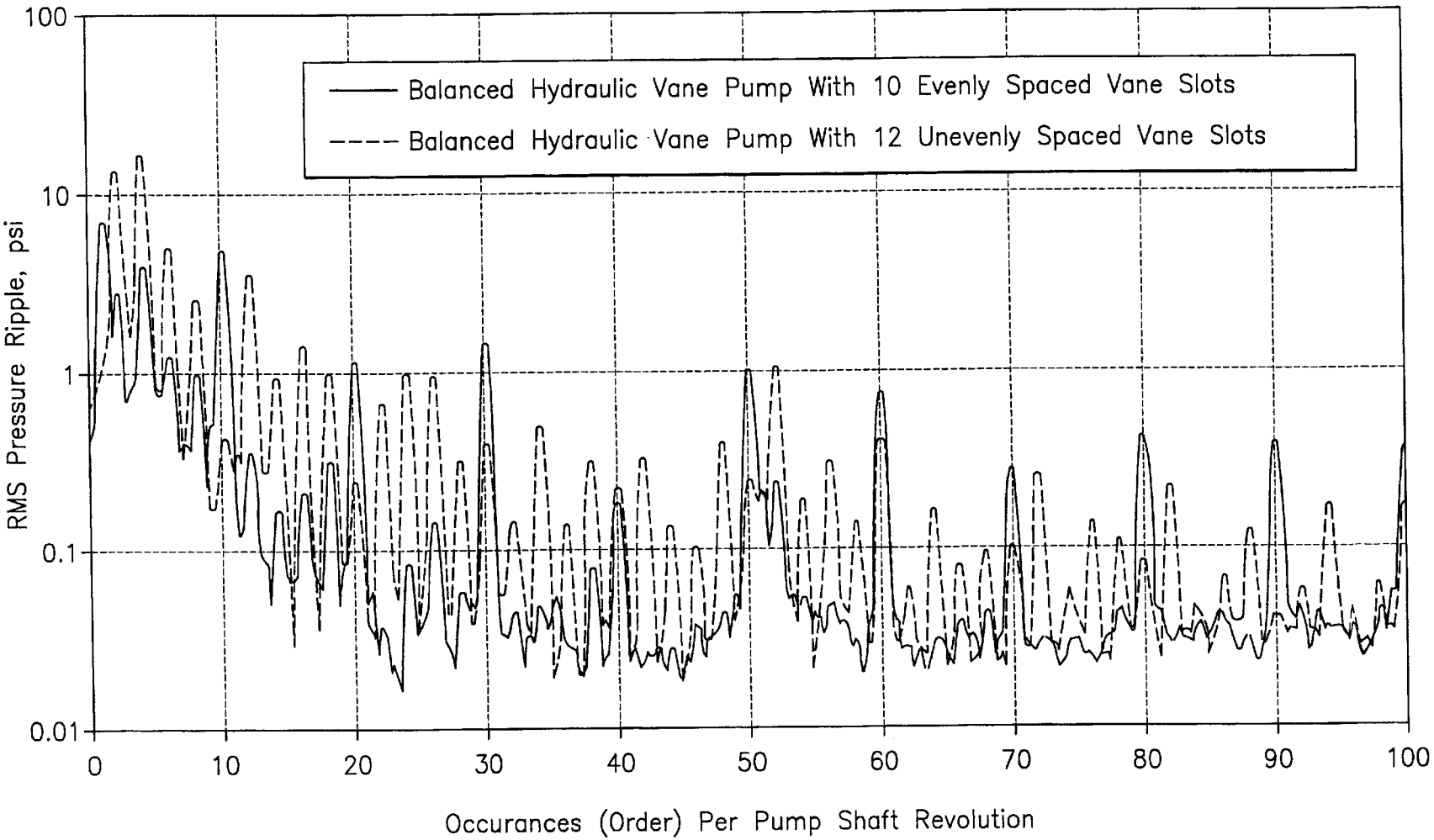
FIG. 4 is a graph comparing the pressure ripple amplitudes for the sliding vane hydraulic pump of FIG. 2 with that of FIG. 3.

FIG. 4 compares the frequency spectrum of pressure ripple from a pump that has 12 unevenly spaced vanes (dashed line) to the conventional pump having 10 evenly spaced vanes (solid line). Note the existence of an increased number of harmonic tones that are interspersed in the spectrum for the pump with unevenly spaced vanes (dashed line). Note also the increase in the amount of energy in the spectrum. Even though the overall energy (spectral content) of the pressure ripple has increased, the annoyance is reduced because the source of the sound (pressure ripple) is more broadband and much less tonal in nature. The presence of the extra harmonics is indicative of the spreading of energy among many frequencies.

Figure 5:
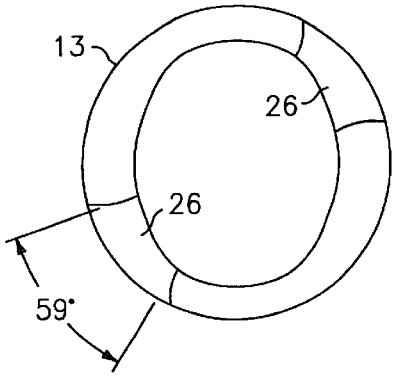
FIG. 5 (PRIOR ART)
FIG. 5 shows a plan view of a conventional pump ring.
Figure 6:
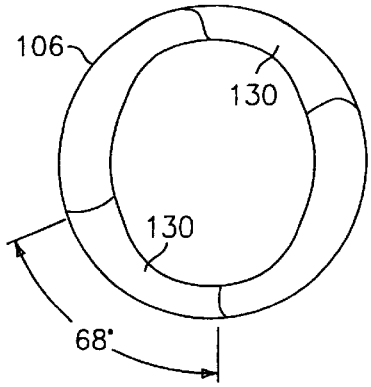
FIG. 6 shows a plan view of another pump ring.

Turning to FIG. 5, a conventional pump ring 13 is shown in plan view. Pump ring 13 includes two notches 26 which form part of the inlet 16 to chamber 15 (FIG. 2). For reasons unknown, these notches have traditionally matched the notch length in pressure plate 108 and thrust plate 110 shown in FIG. 1. FIG. 6 shows a pump ring 106, having notches 130 of approximately 68 degrees. The shape of notches 130 can be seen clearly in FIG. 1. FIG. 1 also shows that notches 121 in pressure plate 108 and thrust plate 110 have not been extended, and remain at about 59 degrees.

The inventors found that by lengthening notches 130 to approximately 68 degrees, the cavitation speed of the pump, i.e., the speed at which cavitation is initiated, is greatly increased, thus greatly increasing the operating speed range of the pump. In fact, pump 100 has reliably operated without cavitation at speeds as high as 7,000 rpm with a pump ring having a 68 degree notch. The inventors found that any lengthening of the inlet notches improves performance of the pump up to a maximum length where the inlets and outlets are not spaced apart by more than the width of a pumping cavity. At this inlet notch length, an effective seal cannot be maintained, and performance is adversely affected.

Example

Figure 7:
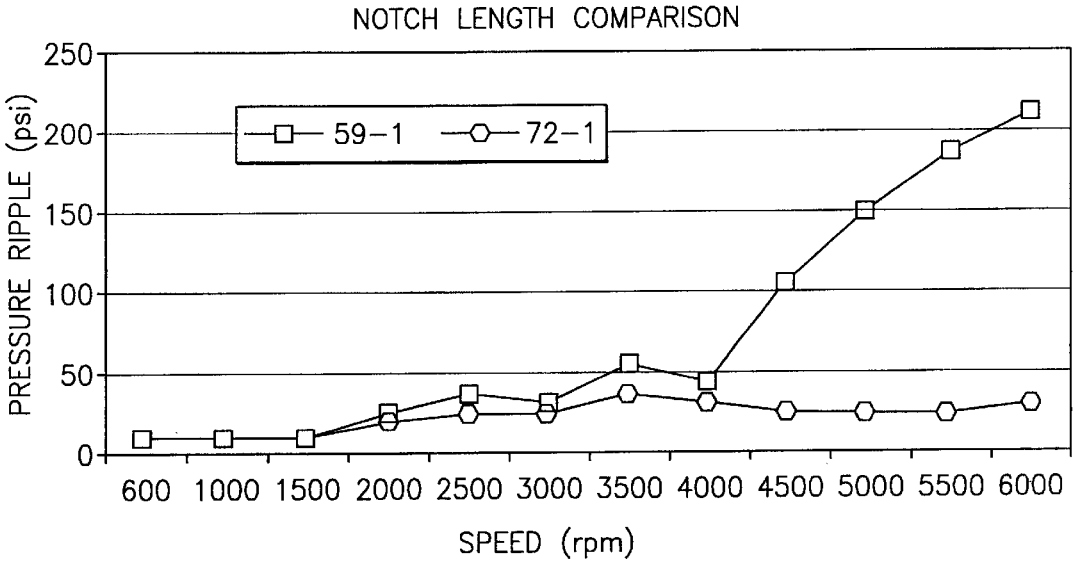
FIG. 7 shows a graph comparing the pressure ripple performance of the pump rings of FIGS. 5 and 6.

FIG. 7 shows test result data comparing cavitation speed (the approximate speed at which cavitation is initiated) with notch length, in terms of the angle that the notch extends around a pump ring. The graph shows the pressure ripple in pounds per square inch for each speed from 600 to 6000 rpm. FIG. 7 shows a pump with a 59 degree notch compared with a pump having a 72 degree notch. Note that, for the 59 degree notch, the pressure ripple greatly increases after 4000 rpm, indicating an inception of cavitation somewhere between 4,000 and 4,500 rpm. This is consistent with prior art pumps of this type. However, the pump having a 72 degree notch exhibits no cavitation all the way to 6000 rpm.

These test results show that an unexpected significant increase in cavitation speed is realized by simply increasing the notch size. Further investigation may show that changing the size and/or shape of notches 121 (FIG. 1) of pressure plate 108 or thrust plate 110 may also be beneficial in increasing the cavitation speed.

Figure 8:
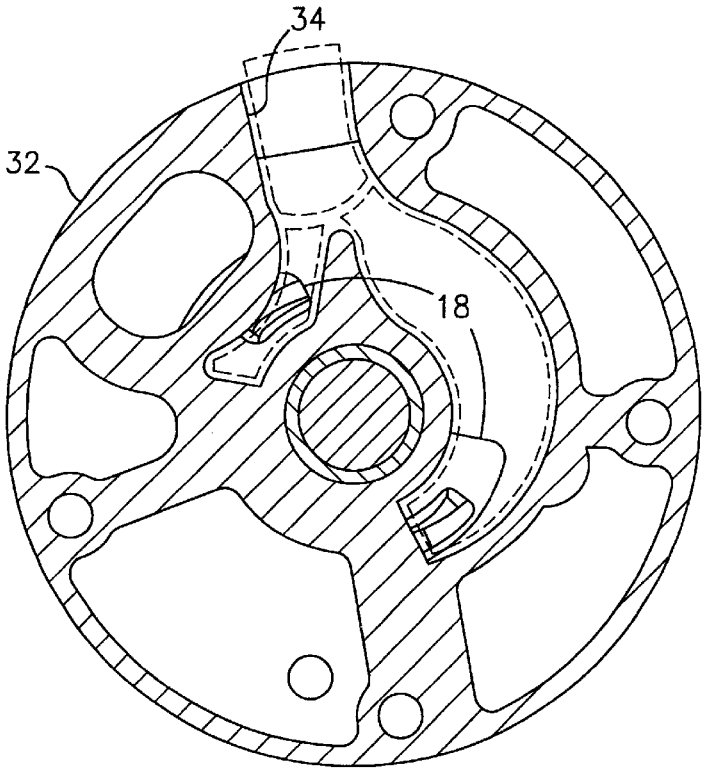
FIG. 8 (PRIOR ART)
FIG. 8 is a cross section view of a conventional discharge housing.

A conventional discharge housing 32 is shown in cross-section in FIG. 8. Here, the dual internal discharge ports 18 are in communication with a single external discharge port 34. This combines the flows from both discharge parts 18 to provide a single output of pump 10 (FIG. 2) and ensuring that the rotor remains hydraulically balanced.

Figure 9:
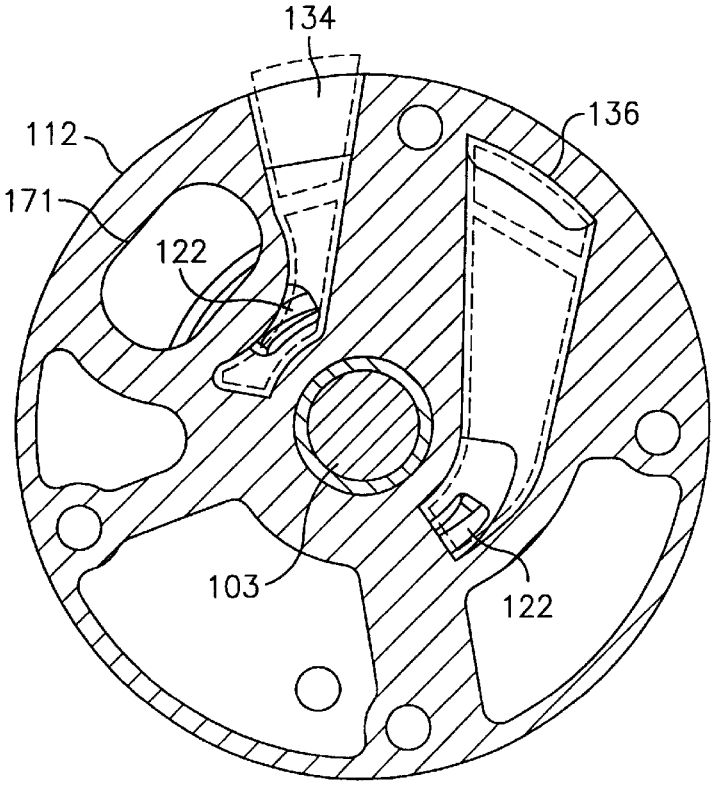
FIG. 9 is a cross section view of another discharge housing.

FIG. 9 shows a cross section of discharge housing 112 in which each internal discharge port 122 is connected to a separate external discharge port 134, 136. The external discharge ports include primary external discharge port 134 and secondary external discharge port 136. Having separate external discharge ports 134, 136 allows pump 100 to operate at one-half or full capacity. When operating at one half capacity, only primary external discharge port 134 is connected to a load while the secondary external discharge port 136 is connected to a low-pressure reservoir. Since only one side of rotor 104 in FIG. 1 is doing the actual work of pumping, the torque required to operate the pump is reduced by approximately one half.

Of course, external discharge ports 134 and 136 are interchangeable and are designated "primary" and "secondary" only to distinguish them, i.e., either port may be designated "primary" and be connected to the load when operating at half-capacity.

Figure 10:
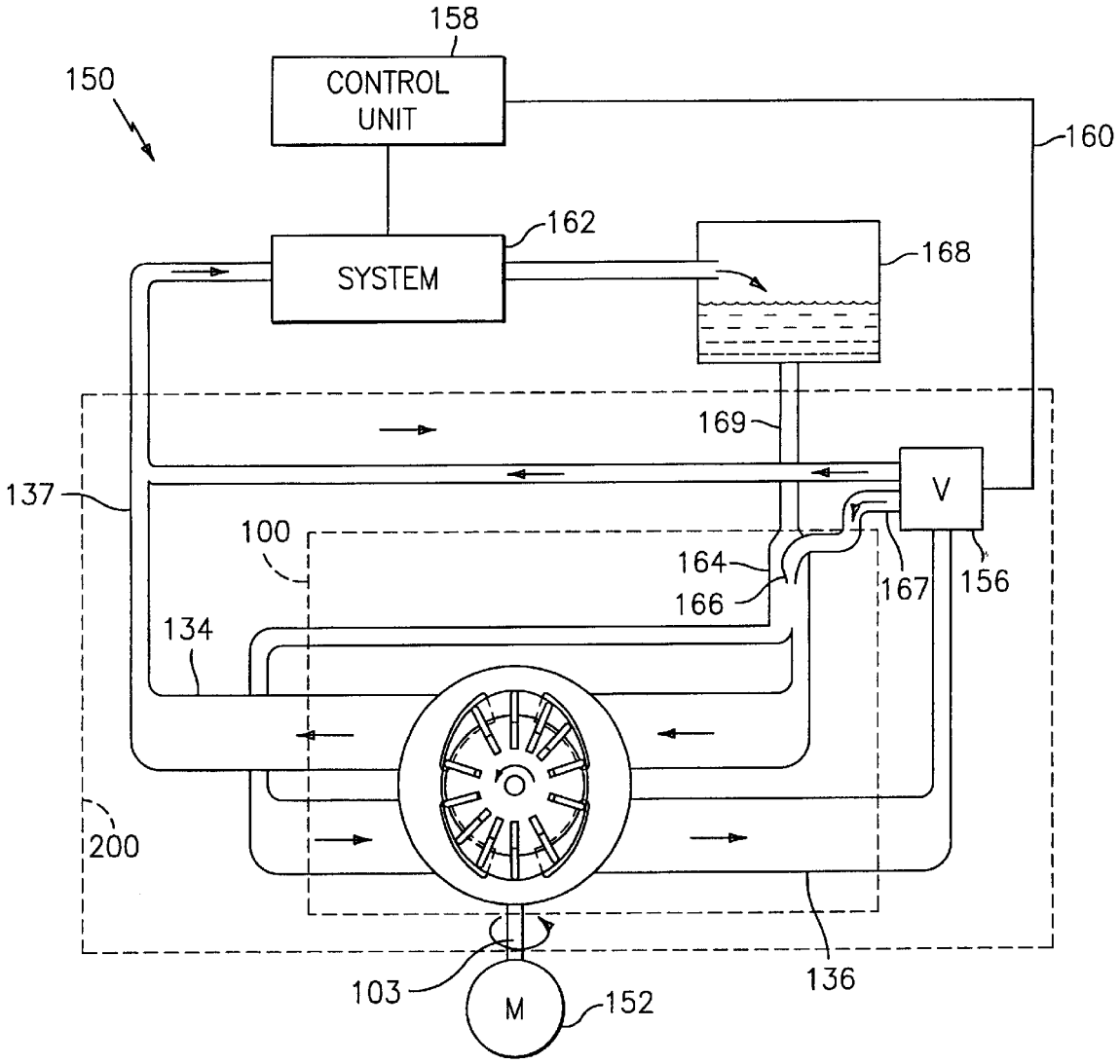
FIG. 10 is a schematic representation of an exemplary hydraulic system making use of a pump having the discharge housing of FIG. 9.

An exemplary system 150 utilizing pump 100 will now be described with reference to FIG. 10. FIG. 10 schematically shows pump 100 providing pressure and flow to system 162, which constitutes a load. System 162 may be any type of hydraulic power system, such as a hydraulic actuator, e.g., a lift, or a power transfer system such as an automotive variable transmission. Pump 100 is driven by shaft 103 which in turn is driven by motive power source 152. Motive power source 152 may be an electric motor, an internal combustion engine, or other source of mechanical power. Fluid exits pump 100 by primary external discharge port 134 and secondary external discharge port 136. Flow from primary external discharge port 134 passes directly to system 162 via path 137.

Flow discharged from system 162 is discharged to low pressure reservoir 168, which is in communication with pump inlet 169, from which it is divided and passed to respective internal inlets 118 (FIGS. 1, 3) to be repressurized.

Flow from secondary external discharge port 136 passes to valve 156 which directs the flow to path 137 and/or jet supercharger 164. Valve 156 includes an actuator (not shown) that receives signals along line 160 from control unit 158. Control unit 158 operates to adjust valve 156 depending on the flow requirements of system 162. When operating at full capacity, valve 156 directs all of the flow from secondary external discharge port 136 to path 137 to combine with the flow from primary external discharge port 134, which will then be directed to system 162. When operating at half capacity, all of the flow from secondary external discharge port 136 is directed to jet supercharger 164, via supercharger inlet 167. Jet supercharger 164 includes a nozzle 166. As fluid passes through nozzle 166, the fluid accelerates and entrains additional fluid from reservoir 168, increasing the pressure at internal inlets 118 (FIGS. 1, 3), thereby improving performance and increasing its operating speed range. If the use of jet supercharger 164 is not desirable, it is of course contemplated that valve 156 could instead direct flow to another low pressure location, such as reservoir 168, or to another system that requires hydraulic power.

Referring again to FIG. 1, note that supercharger 164 is located just beneath discharge housing 112 and forms part of the structure of pump 100 or is otherwise fixedly attached to it. Low pressure inlet 169 is not visible in FIG. 1, but is located just to the left of supercharger inlet 167. The flows are combined as schematically represented in FIG. 10, and the combined flow exits supercharger 164 and passes through opening 171 (FIG. 9) in discharge housing 112 to annular space 116 described above with reference to FIG. 1.

It is contemplated that valve 156 could be also incorporated into the pump housing that comprises rotor housing 102 and discharge housing 112 shown in FIG. 1. This would necessitate connecting only one line from reservoir 168 to pump 100 and only one line from pump 100 to system 162 in FIG. 10. This would reduce installation time and improve reliability by reducing the number connections and hoses required. Such a configuration would include a housing for all the elements encompassed by box 200 in FIG. 10.

Valve 156 is an on/off valve so that it can direct all the fluid from external discharge port 136 to either system 162 or supercharger 164.

Supercharger 164 presents a lower back-pressure to secondary external discharge port 136, thereby reducing the overall torque required to drive pump 100 when operating at less than full capacity.

While preferred embodiments have been shown and described, various modifications and substitutions may be made thereto without departing from the spirit and scope of the invention. Accordingly, it is to be understood that the present invention has been described by way of illustration only, and such illustrations and embodiments as have been disclosed herein are not to be construed as limiting to the claims.

What is claimed is:

1. A pump comprising:

a rotor housing having a pumping chamber;

a rotor in said pumping chamber, said rotor having a plurality of radially disposed slots;

a plurality of sliding vanes disposed in said slots, said sliding vanes configured to extend to follow an inner wall of said pumping chamber;

said pumping chamber having at least two internal inlet ports and at least two internal discharge ports, said internal inlet ports, internal discharge ports, rotor, and vanes all configured to pump fluid from said internal inlet ports to said internal discharge ports as said rotor rotates within said pumping chamber;

a discharge housing fixedly attached to said rotor housing, said discharge housing being in communication with said internal discharge ports and providing at least two external discharge ports, said discharge housing having fluid paths passing all the fluid from one of said internal discharge ports to one of said external discharge ports such that all the fluid exiting said pumping chamber through said one of said internal discharge ports passes through said one of said external discharge ports, said discharge housing including additional fluid paths passing all of said fluid from a second of said internal discharge ports through one of said first external discharge ports and a second of said external discharge ports.

2. The pump set forth in claim 1 wherein at least one of said slots is offset from an equally-spaced configuration.

3. The pump set forth in claim 2 wherein said rotor contains n slots, and said slots are located such that no angles between a first set of n/2 consecutive adjacent slots are duplicated within said first set of n/2 slots.

4. The pump set forth in claim 3 wherein angles between a second set of n/2 consecutive adjacent slots are identical to said angles between the first set of n/2 slots so that each said slot has a corresponding slot located 180 degrees away.

5. The pump set forth in claim 4 wherein n equals 12.

6. The pump set forth in claim 1 wherein said pumping chamber is defined by a pressure plate on one side of said rotor, said pressure plate being disposed generally perpendicularly to an axis of rotation of said rotor, a thrust plate on an opposite side of said rotor, said thrust plate disposed generally perpendicularly to said axis of rotation of said rotor, and a pump ring disposed between said thrust plate and said pressure plate and surrounding said rotor;

said pump ring having at least two inlet notches circumferentially spaced apart, each said notch defining at least part of a corresponding one of said inlet ports;

each said inlet notch extending circumferentially at least 60 degrees around said pump ring.

7. The pump set forth in claim 6 wherein said inlet notch extends circumferentially at least 65 degrees around said pump ring.

8. The pump set forth in claim 7 wherein said inlet notch extends circumferentially approximately 68 degrees around said pump ring.

9. A pump comprising:

a rotor housing having a pumping chamber;

a rotor in said pumping chamber, said rotor having a plurality of radially disposed slots;

a plurality of sliding vanes disposed in said slots, said sliding vanes configured to extend to follow an inner wall of said pumping chamber;

said pumping chamber having at least two internal inlet ports and at least two internal discharge ports, said internal inlet ports, internal discharge ports, rotor, and vanes all configured to pump fluid from said internal inlet ports to said internal discharge ports as said rotor rotates within said pumping chamber; and wherein said rotor contains n slots, and said slots are located such that no angles between the first set of n/2 consecutive adjacent slots are duplicated within the first set of n/2 slots.

10. The pump set forth in claim 9 wherein angles between a second set of n/2 consecutive adjacent slots are identical to said angles between the first set of n/2 slots so that each said slot has a corresponding slot located 180 degrees away.

11. The pump set forth in claim 10 wherein n equals 12.

12. The pump set forth in claim 9 wherein said pumping chamber is defined by a pressure plate on one side of said rotor, said pressure plate being disposed generally perpendicularly to an axis of rotation of said rotor, a thrust plate on an opposite side of said rotor, said thrust plate disposed generally perpendicularly to said axis of rotation of said rotor, and a pump ring disposed between said thrust plate and said pressure plate and surrounding said rotor;

said pump ring having at least two inlet notches circumferentially spaced apart, each said notch defining at least part of a corresponding one of said inlet ports;

each said inlet notch extending circumferentially at least 60 degrees around said pump ring.

13. The pump set forth in claim 12 wherein said inlet notch extends circumferentially at least 65 degrees around said pump ring.

14. The pump set forth in claim 13 wherein said inlet notch extends circumferentially approximately 68 degrees around said pump ring.

15. The pump set forth in claim 9 wherein each said internal discharge port is in communication with a corresponding external discharge port so that fluid from each said external discharge port may be separately utilized.

16. The pump set forth in claim 15 further comprising:

a discharge housing fixedly attached to said rotor housing, said discharge housing being in communication with said internal discharge ports and carrying said external discharge ports, said discharge housing having fluid paths connecting said internal discharge ports to said external discharge ports.

17. A pump comprising:

a rotor housing having a pumping chamber;

a rotor in said pumping chamber, said rotor having a plurality of radially disposed slots;

a plurality of sliding vanes disposed in said slots, said sliding vanes configured to extend to follow an inner wall of said pumping chamber;

said pumping chamber having at least two internal inlet ports and at least two internal discharge ports, said internal inlet ports, internal discharge ports, rotor, and vanes all configured to pump fluid from said internal inlet ports to said internal discharge ports as said rotor rotates within said pumping chamber;

wherein said pumping chamber is defined by a pressure plate on one side of said rotor, said pressure plate being disposed generally perpendicularly to an axis of rotation of said rotor, a thrust plate on an opposite side of said rotor, said thrust plate disposed generally perpendicularly to said axis of rotation of said rotor, and a pump ring disposed between said thrust plate and said pressure plate and surrounding said rotor;

said pump ring having at least two inlet notches circumferentially spaced apart, each said notch defining at least part of a corresponding one of said inlet ports; and each said inlet notch extending circumferentially at least 60 degrees around said pump ring.

18. The pump set forth in claim 17 wherein said inlet notch extends circumferentially at least 65 degrees around said pump ring.

19. The pump set forth in claim 18 wherein said inlet notch extends circumferentially approximately 68 degrees around said pump ring.

20. The pump set forth in claim 17 wherein each said internal discharge port is in communication with a corresponding external discharge port so that fluid from each said external discharge port may be separately utilized.

21. The pump set forth in claim 20 further comprising:

a discharge housing fixedly attached to said rotor housing, said discharge housing being in communication with said internal discharge ports and carrying said external discharge ports, said discharge housing having fluid paths connecting said internal discharge ports to said external discharge ports.

22. The pump set forth in claim 17 wherein at least one of said slots is offset from an equally-spaced configuration.

23. The pump set forth in claim 22 wherein said rotor contains n slots, and said slots are located such that no angles between a first set of n/2 consecutive adjacent slots are duplicated within said first set of n/2 slots.

24. The pump set forth in claim 23 wherein angles between a second set of n/2 consecutive adjacent slots are identical to said angles between the first set of n/2 slots so that each said slot has a corresponding slot located 180 degrees away.

25. The pump set forth in claim 24 wherein n equals 12.

26. A pumping system comprising:

a pump having at least one inlet and a plurality of substantially pressure-independent discharge ports;

a first flow path extending from a low pressure reservoir to said at least one inlet;

a second flow path extending from a first one of said discharge ports to a load, said load discharging said fluid to said low pressure reservoir;

a third flow path extending from a second one of said discharge ports to a valve, a fourth flow path extending from said valve to said load;

a fifth flow path extending from said valve to a low pressure location upstream from said inlet; and wherein said valve is operable to connect said third flow path to said fourth flow path and said fifth flow path.

27. The pumping system set forth in claim 26 further comprising a jet supercharger on said first flow path and said fifth flow path extends from said valve to a nozzle in said jet supercharger.

28. The pumping system of claim 26 wherein said pump comprises:

a rotor housing having a pumping chamber;

a rotor in said pumping chamber, said rotor having a plurality of radially disposed slots;

a plurality of sliding vanes disposed in said slots, said sliding vanes configured to extend to follow an inner wall of said pumping chamber;

said pumping chamber having at least two internal inlet ports and at least two internal discharge ports, said internal inlet ports, internal discharge ports, rotor, and vanes all configured to pump fluid from said internal inlet ports to said internal discharge ports as said rotor rotates within said pumping chamber; wherein each said internal discharge port being in communication with a corresponding one of said discharge ports so that fluid from each said discharge port may be separately utilized.

29. The pumping system set forth in claim 28 further comprising:

a discharge housing fixedly attached to said rotor housing, said discharge housing being in communication with said internal discharge ports and carrying said discharge ports, said discharge housing having fluid paths connecting said internal discharge ports to said discharge ports.

30. The pumping system of claim 26 wherein said pump comprises:

a rotor housing having a pumping chamber;

a rotor in said pumping chamber, said rotor having a plurality of radially disposed slots;

a plurality of sliding vanes disposed in said slots, said sliding vanes configured to extend to follow an inner wall of said pumping chamber;

said pumping chamber having at least two internal inlet ports and at least two internal discharge ports, said internal inlet ports, internal discharge ports, rotor, and vanes all configured to pump fluid from said internal inlet ports to said internal discharge ports as said rotor rotates within said pumping chamber; and wherein at least one of said slots is offset from an equally-spaced configuration.

31. The pumping system set forth in claim 30 wherein said rotor contains n slots, and said slots are located such that no angles between a first set of n/2 consecutive adjacent slots are duplicated within said first set of n/2 slots.

32. The pumping system set forth in claim 31 wherein angles between a second set of n/2 consecutive adjacent slots are identical to said angles between the first set of n/2 slots so that each said slot has a corresponding slot located 180 degrees away.

33. The pumping system set forth in claim 32 wherein n equals 12.

34. The pumping system of claim 26 wherein said pump comprises:

a rotor housing having a pumping chamber;

a rotor in said pumping chamber, said rotor having a plurality of radially disposed slots;

a plurality of sliding vanes disposed in said slots, said sliding vanes configured to extend to follow an inner wall of said pumping chamber;

said pumping chamber having at least two internal inlet ports and at least two internal discharge ports, said internal inlet ports, internal discharge ports, rotor, and vanes all configured to pump fluid from said internal inlet ports to said internal discharge ports as said rotor rotates within said pumping chamber;

said pumping chamber is defined by a pressure plate on one side of said rotor, said pressure plate being disposed generally perpendicularly to an axis of rotation of said rotor, a thrust plate on an opposite side of said rotor, said thrust plate disposed generally perpendicularly to said axis of rotation of said rotor, and a pump ring disposed between said thrust plate and said pressure plate and surrounding said rotor;

said pump ring having at least two inlet notches circumferentially spaced apart, each said notch defining at least part of a corresponding one of said inlet ports; and each said inlet notch extending circumferentially at least 60 degrees around said pump ring.

35. The pumping system set forth in claim 34 wherein said inlet notch extends circumferentially at least 65 degrees around said pump ring.

36. The pumping system set forth in claim 35 wherein said inlet notch extends circumferentially approximately 68 degrees around said pump ring.

* * * * *